US005926928A

United States Patent [19]

Lundstedt

[11] Patent Number: 5,926,928

[45] Date of Patent: Jul. 27, 1999

[54] VENTED SIDE RELEASE BUCKLE

[75] Inventor: Kurt H. Lundstedt, Hawthorne Woods, Ill.

[73] Assignee: Illinois Tool Works Inc., Glenview, Ill.

[21] Appl. No.: 09/039,700

[22] Filed: Mar. 16, 1998

[51] Int. Cl.[6] ..... A44B 11/25

[52] U.S. Cl. ..... 24/625; 24/615

[58] Field of Search ..... 24/614, 615, 616, 24/625, 651

[56] References Cited

U.S. PATENT DOCUMENTS

| | | | |
|---|---|---|---|
| 4,408,375 | 10/1983 | Skobel | 24/625 |
| 4,928,364 | 5/1990 | Ikeda | 24/615 X |
| 5,222,279 | 6/1993 | Frano et al. . | |
| 5,383,257 | 1/1995 | Krauss | 24/625 |
| 5,419,020 | 5/1995 | Murai | 24/625 |
| 5,548,897 | 8/1996 | Wu | 24/625 |
| 5,774,956 | 7/1998 | Fench et al. | 24/625 |
| 5,794,316 | 8/1998 | Anscher | 24/625 |

*Primary Examiner*—James R. Brittain
*Assistant Examiner*—Robert J. Sandy
*Attorney, Agent, or Firm*—Schwartz & Weinrieb

[57] ABSTRACT

A side release buckle having a female member with a receptacle for receiving a tongue portion of a male member. One or more openings through the male member are alignable at least partially with corresponding openings through the female member when the tongue portion of the male member is disposed in the receptacle of the female member, whereby the at least partially aligned openings of the male and female members form corresponding apertures through the side release buckle. The openings may include one or more rib members for strength. The side release buckles have, among other advantages, reduced weight without compromising strength, and are suitable for applications where it is desirable to vent the buckle, or permit underlying fabric or structure to be at least partially visible therethrough, or to accept a locking member to prevent or deter casual release of the male and female members.

21 Claims, 1 Drawing Sheet

VENTED SIDE RELEASE BUCKLE

FIELD OF THE INVENTION

The present invention relates generally to buckles, and more particularly to side release buckles having releasably engageable male and female members.

BACKGROUND OF THE INVENTION

Releasably engageable side release buckle members are known generally and used widely for fastening one or more free ends of strap, or web, in an ever increasing range of applications including cargo and personnel restraints, personal floatation devices, and outerwear, among other applications.

U.S. Pat. No. 5,222,279, issued on Jun. 29, 1993, entitled "Buckle Having Increased Holding Power When Under Load" discloses a typical side release buckle having a female receptacle member with an interior channel for receiving resilient arms of a male latch member. The resilient arms include a shoulder or other portion cooperatively engageable with corresponding engagement surfaces of the female receptacle member when inserted into the channel thereof. The resilient arms of the male member are accessible through apertures in opposing sides of the female member, and the arms are flexible inwardly toward each other so as to disengage the shoulders thereof from the engagement surfaces of the female member, thereby releasing and separating the male and female members.

The present invention is drawn toward advancements in the art of buckle members, and more particularly to novel improvements in side release buckles.

OBJECTS OF THE INVENTION

It is an object of the invention to provide novel side release buckles that overcome problems in the prior art, and that are relatively economical to manufacture.

It is another object of the invention to provide novel side release buckles that are suitable for use in applications where it is desirable to vent the buckle, especially in outerwear applications including head gear and shoulder pack applications where the buckle contacts the user's skin or clothing, whereby the vented buckle eliminates or at least substantially reduces uncomfortable perspiratory moisture accumulation between the buckle and the user.

It is another object of the invention to provide novel side release buckles that will accept a shank or other locking member to prevent or at least deter casual opening of latchable male and female members thereof, and side release buckles that permit ready removal of debris that may become lodged in recesses thereof.

It is a further object of the invention to provide novel side release buckles that are relatively lightweight, and especially side release buckles that are lightweight without compromising strength.

It is yet another object of the invention to provide novel side release buckles that permit underlying fabric or structure to be at least partially visible therethrough, and for some applications it is an object of the present invention to provide novel side release buckles that have an appearance of lightweightedness.

It is still another object of the invention to provide novel side release buckles that have reduced molding cycle times to increase manufacturing productivity.

It is a more particular object of the invention to provide novel side release buckles having a female member with a receptacle for receiving a tongue portion of a male member, wherein one or more openings of the male member are alignable at least partially with corresponding openings of the female member when the tongue portion of the male member is disposed in the receptacle of the female member, whereby the at least partially aligned openings of the male and female members form one or more corresponding apertures through the side release buckle.

It is another more particular object of the invention to provide novel side release buckles having a first rib member separating a first portion of an opening through a first side wall of the female member, and a second rib member separating a second portion of an opening through a second side wall of the female member, thereby providing at least one of the advantages above without compromising strength.

BRIEF DESCRIPTION OF THE DRAWINGS

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators throughout the several views, and wherein.

DETAILED DESCRIPTION OF THE INVENTION

Figure 1:
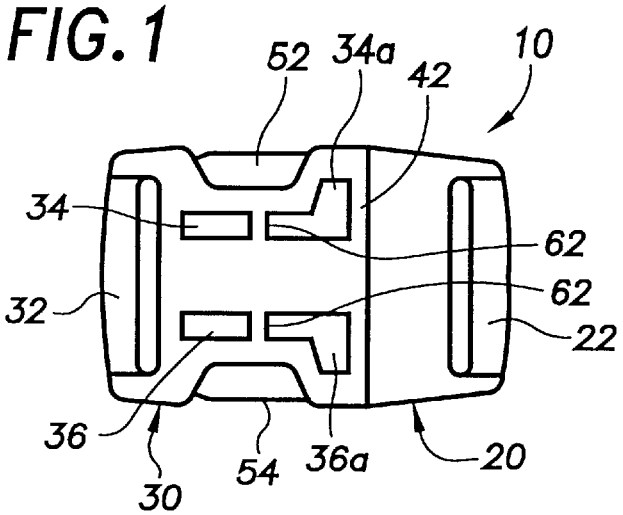
FIG. 1 is a top plan view of a side release buckle according to an exemplary embodiment of the invention.
Figure 2C:
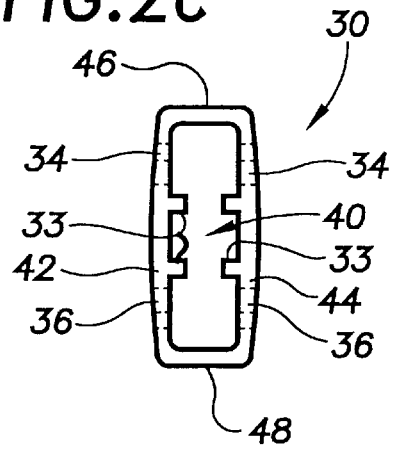
FIG. 2*c* is an end view along lines 2*c*–2*c* of FIG. 2*a*.
Figure 2A:
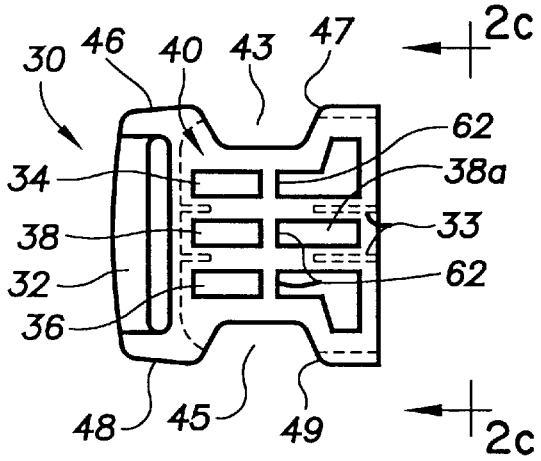
FIG. 2*a* is a top plan view of a side release buckle female member according to an alternative exemplary embodiment of the invention.
Figure 2B:
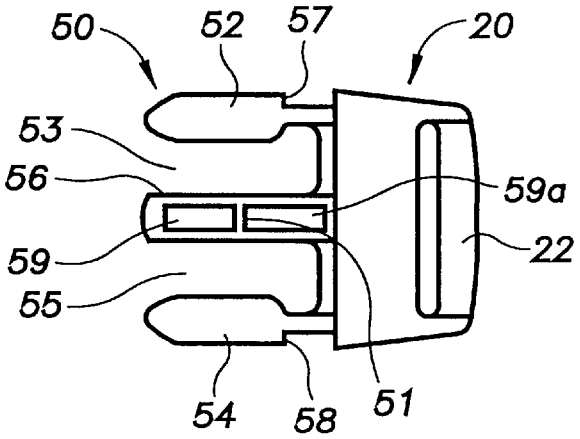
FIG. 2*b* is a top plan view of a side release buckle male member useable in combination with the exemplary embodiments of FIGS. 1 and 2*a*.

FIG. 1 illustrates a side release buckle 10 according to an exemplary embodiment of the invention comprising generally a male member 20 releasably engageable with a female member 30. FIG. 2*c* illustrates the female member 30 having a receptacle 40 defined partially by first and second substantially opposing side walls 42 and 44 and substantially opposing end walls 46 and 48, also shown partially in FIG. 2*a*. FIG. 2*b* illustrates the male member 20 having a tongue portion 50 disposable in the receptacle 40 of the female member 30, as in FIG. 1. The male and female members 20 and 30 each have corresponding engagement surfaces that cooperate to form a releasable coupling as discussed further below. FIGS. 1, 2*a* and 2*b* illustrate the male and female members 20 and 30 including alternatively one or more corresponding strap engaging members 22 and 32, respectively, about which a free strap end, not shown, is disposed and retained as is known generally.

Generally, the male member 20 has at least one opening disposed through the tongue portion 50 thereof, and the female member 30 has at least one opening disposed through the substantially opposing side walls 42 and 44 thereof. The opening or openings in the male member 20 are alignable at least partially with corresponding openings in the female member 30 when the tongue portion 50 of the male member 20 is disposed in the receptacle 40 of the female member 30 to form corresponding apertures that extend fully through the buckle 10, as shown in FIG. 1.

FIGS. 1, 2*a* and 2*c* illustrate first and second openings 34 and 36 disposed through the first and second substantially opposing side walls 42 and 44 of the female member 30. FIG. 2*b* illustrates the tongue portion 50 of male member 20 having first and second laterally disposed resilient arm members 52 and 54 separated by recesses 53 and 55, which permit inwardly flexing of the arm members 52 and 54 to engage the female member 30 as is known generally and discussed further in an exemplary embodiment below. FIG. 2*b* also illustrates the tongue portion 50 having a guide arm 56 disposed between and separated from the first and second laterally disposed arm members 52 and 54 by the first and second recesses 53 and 55. In alternative embodiments, the guide arm 56 is absent, and the recesses 53 and 55 form a common recess. The openings through the male member 20 are thus defined by the corresponding recesses 53 and 55, and in the absence of the guide arm 56, a single opening through the male member 20 is defined by a common recess between the arm member 52 and 54.

In the exemplary embodiment of FIG. 1, the openings 53 and 55 of the male member 20 are at least partially alignable with the openings 34 and 36, respectively, of the female member 30 when the tongue portion 50 of the male member 20 is disposed in the receptacle 40 of the female member 30 to form corresponding apertures that extend fully through the buckle 10, as shown in FIG. 1. Alternatively, absent the guide arm 56 of the male member 20, the corresponding common recess, or opening, between the arm members 52 and 54 is alignable at least partially with the openings 34 and 36 of the female member when the tongue portion 50 of the male member 20 is disposed in the receptacle 40 of the female member also forming corresponding apertures that extend through the buckle 10 shown in FIG. 1.

FIG. 2*a* illustrates an alternative embodiment wherein the female member 30 has a third or centrally located opening 38 therethrough in addition, or as an alternative, to the openings 34 and 36. And FIG. 2*b* illustrates the tongue portion 50 of male member 20 having a third opening 59 formed through the guide arm 56 in addition to the openings defined by recesses 53 and 55. According to this alternative configuration, the opening 59 of the male member 20 is at least partially alignable with the opening 38 of the female member 30 when the tongue portion 50 of the male member 20 is disposed in the receptacle 40 of the female member 30 to form a corresponding aperture that extends through the buckle 10. Alternatively, absent the guide arm 56 of the male member 20, the corresponding common recess, or opening, between the arm members 52 and 54 is alignable at least partially with the opening 38 and or openings 34 and 36 of the female member 30 when the tongue portion 50 of the male member 20 is disposed in the receptacle 40 of the female member 30 forming corresponding apertures that extend through the buckle 10.

Figure 3A:
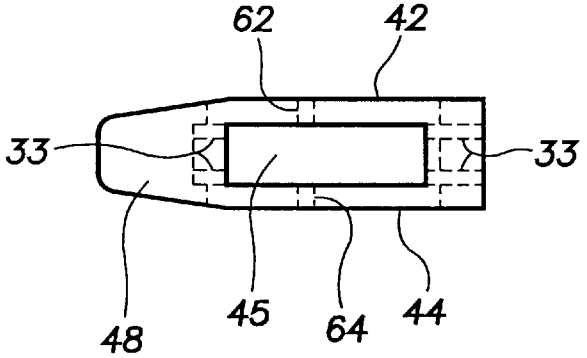
FIG. 3*a* is a side view of a side release buckle female member according to an exemplary embodiment of the invention.
Figure 3B:
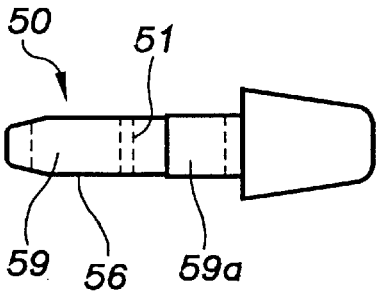
FIG. 3*b* is a side view of a side release buckle male member according to the exemplary embodiment of FIG. 2*b*.

FIGS. 1, 2*a* and 3*a* further illustrate corresponding first rib members 62 separating corresponding first portions of the openings 34, 36 and 38 disposed through the first side wall 42 of the female member 30, and FIG. 3*a* illustrates second rib members 64 separating a second portion of the openings 34, 36 and 38 disposed through the second side wall 44 of the female member 30, thereby forming corresponding opening portions 34*a*, 36*a*, and 38*a* in the first and second side walls 42 and 44 of the female member 30. The first rib members 62 in the first side wall 42 of the female member 30 are aligned with the second rib members 64 in the second side wall 44 of the female member 30 as shown in FIG. 3*a*.

The rib members increase the rigidity of the female member 30 and the buckle 10 generally, and are desirable for some applications, particularly applications having one or more elongated openings with end portions extending between the strap engaging members 22 and 32 as illustrated in FIGS. 1, 2*a* and 2*b*. In the exemplary embodiments, the rib members 62 are disposed transversely relative to the elongated dimension of the openings. Other embodiments may include more than one rib member in each opening, depending on the elongated dimension of the opening and strength requirements for a particular application, and in other applications one or more openings may not require any rib members.

The first and second openings 53 and 55 of the tongue portion 50 of the male member 20 generally do not require rib members since the resilient arm members 52 and 54 must be free to flex for coupling and releasing the male and female members 20 and 30 as discussed in an exemplary embodiment below. The third opening 59 in the male member 20 may include a rib member 51, thereby forming a corresponding opening portion 59*a* in the guide arm 56 of the male member 20, wherein the rib 51 is preferably aligned with any rib members 62 and 64 disposed in the corresponding opening portions 38 of the female member 30.

FIGS. 2*a* and 3*a* illustrate the first and second substantially opposing end walls 46 and 48 of the female member 30 having corresponding first and second end recesses or apertures 43 and 45 with engagement surfaces 47 and 49 cooperatively engagable with corresponding portions, or engagement surfaces, 57 and 58 of the first and second laterally disposed arms 52 and 54 of the male member 20, shown in FIG. 2*b*, to engagably couple the male and female members 20 and 30, as illustrated in FIG. 1. To release the engaged male and female members 20 and 30, the first and second laterally disposed arms 52 and 54 are flexed inwardly toward each other so as to disengage the engagement surfaces 57 and 58 of the male member 20 from the engagement surfaces 47 and 49 of the female member 30. Various alternative side release buckle engagement configurations are known generally and are useable alternatively to releasably couple the male and female members 20 and 30 of the buckle 10.

Thus according to the present invention, the male and female members 20 and 30 include one or more corresponding openings, which are alignable at least partially when the tongue portion 50 of the male member 20 is disposed in the receptacle 40 of the female member 30. The one or more openings may be arranged symmetrically as illustrated in FIGS. 1, 2*a* and 2*b*. Alternatively, the openings may be arranged or located asymmetrically or otherwise as a particular application requires.

The male and female members 20 and 30 and the one or more openings thereof are formed preferably of a plastic material in a molding operation. In this mode of manufacture, the openings are formed by mold parts during molding, whereby the one or more openings advantageously facilitate relatively rapid cooling or setting of the molded members or articles, thereby reducing mold cycling time and increasing productivity. Alternatively, the one or more openings through the male and female members may be formed in drilling or milling operations after molding or fabrication.

The number, size, orientation, location and shape of the openings and rib members in the buckle member 10 is determined generally by the particular application requirements of the side release buckle. Buckles for applications which require reduced weight or air ventilation or exposure of underlying fabric or structure may have one or more relatively large openings with elongated ends disposed toward the strap engaging members 22 and 32, as shown in the exemplary embodiments of FIGS. 1, 2*a* and 2*b*, to maximize the flow of air through the apertures, or vents, of the side release buckle 10. The number, location and orientation of the rib members, if any, depends largely on the strength requirements of the buckle, and thus also depends on the number and size of the openings.

Buckles for applications where it is desirable to provide an opening for receiving a shank or locking member may require only one or more circular openings large enough to accept passage of the shank through the aperture of the side release buckle, and may be located and sized to provide relatively tight locking retention of the male and female members despite efforts to open the buckle. Such an opening may be located centrally through the female member 30 and through the guide arm 56 of the male member 20 to increase locking strength. Alternatively, plural openings may be located laterally along one or both side portions of the female member 30, for example openings 34 and 36 in FIG. 1. Circular openings or other shaped openings designated for accommodating a lock shank through the side release buckle may be used in combination with, or in addition to, larger openings for weight reduction or air ventilation or openings that permit visibility through the apertures extending through the side release buckle.

A lock shank disposed through an aperture of the side release buckle formed by the elongated central openings 38 and 59 in the female and male members 30 and 20 of FIGS. 2*a* and 2*b* will prevent opening of the buckle with or without rib members. A lock shank disposed through one of the laterally disposed elongated openings 34 and 36 in FIG. 1 will also prevent opening of the buckle by preventing or at least frustrating inwardly flexing of at least one of the arm members 52 or 54, which is generally necessary to release the male and female members 20 and 30.

FIGS. 2*a*, 2*c* and 3*a* illustrate the female member 30 having guiding members 33 disposed on opposing sides of the guide arm 56 when the tongue portion 50 of the male member 20 is disposed in the receptacle 40 of the female member 30, thereby aligning the male and female members 20 and 30 during assembly and coupling of the buckle 10 as is known generally. In the exemplary embodiment, the elongated openings 34, 36 and 38 in the female member 30 are located to accommodate the guiding members 33, which are desirable for many applications. Thus, depending on the application requirements, the number, size and location of the openings may depend also on the location of any guiding members 33.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A side release buckle, comprising:

a male member having a longitudinally extending axis and a tongue portion;

a female member having a longitudinally extending axis, a receptacle, defined partially by first and second substantially opposed side walls, for receiving said tongue portion of said male member, and latching means for releasably retaining said tongue portion of said male member within said receptacle;

an opening defined within and extending through a substantially axially central portion of said tongue portion of said male member so as to define upon said tongue portion of said male member a pair of laterally spaced, flexible latching arms for releasably engaging said latching means of said female member; and a pair of separate openings laterally spaced from each other upon opposite sides of said longitudinally extending axis of said female member, respectively defined within and extending through each one of said first and second substantially opposed side walls of said female member, and having predetermined configurations for at least partial alignment with said opening of said male member when said tongue portion of said male member is disposed within said receptacle of said female member such that said at least partially aligned openings of said male and female members together form corresponding apertures which extend through said side release buckle and which have configurations which are substantially the same as said predetermined configurations of said pair of separate openings defined within said first and second substantially opposed side walls of said female member.

2. The side release buckle of claim 1, further comprising:

a first rib member provided upon said first side wall of said female member for separating a first one of said pair of openings defined within and extending through said first side wall of said female member into a pair of longitudinally spaced first openings; and a second rib member provided upon said second side wall of said female member for separating a second one of said pair of openings defined within and extending through said second side wall of said female member into a pair of longitudinally spaced second openings.

3. The side release buckle of claim 2, wherein the first rib member of the first side wall of the female member is aligned with the second rib member of the second side wall of the female member.

4. The side release buckle of claim 2, wherein the first and second openings through the female member are elongated openings.

5. The side release buckle of claim 1, wherein:

said female member has first and second substantially opposed end walls further defining said receptacle; and first and second end apertures are defined within said first and second substantially opposed end walls of said female member for facilitating manipulation of said first and second laterally disposed latching arms of said male member when it is desired to releasably disengage said male member from said female member.

6. The side release buckle of claim 1, further comprising:

a male strap engagement member disposed upon said male member opposite said tongue portion of said male member; and a female strap engagement member disposed upon said female member opposite said receptacle of said female member.

7. The side release buckle of claim 1, wherein:

said first and second laterally disposed arms of said male member have corresponding shoulder engagement portions; and said female member has first and second substantially opposed end walls further defining said receptacle and having corresponding first and second end aperture edge portions cooperatively engageable with said corresponding shoulder engagement portions of said first and second laterally disposed arms of said male member.

8. A side release buckle, comprising:

a male member having a longitudinally extending axis and a tongue portion;

a female member having a longitudinally extending axis, a receptacle, defined partially by first and second substantially opposed side walls, for receiving said tongue portion of said male member, and latching means for releasably retaining said tongue portion of said male member within said receptacle;

an opening defined within and extending through a substantially axially central portion of said tongue portion of said male member so as to define upon said tongue portion of said male member a pair of laterally spaced, flexible latching arms for releasably engaging said latching means of said female member, and an axially extending guide arm interposed between and separated from said pair of laterally spaced flexible, latching arms so as to divide said opening of said tongue portion of said male member into first and second laterally spaced openings within said tongue portion of said male member; and first and second separate openings laterally spaced from each other upon opposite sides of said longitudinally extending axis of said female member and respectively defined within and extending through each one of said first and second substantially opposed side walls of said female member for at least partial alignment with said first and second openings of said male member when said tongue portion of said male member is disposed within said receptacle of said female member such that said at least partially aligned openings of said male and female members together form apertures through said side release buckle.

9. The side release buckle of claim 8, further comprising:

a first rib member provided upon said first side wall of said female member for separating said first opening defined within and extending through said first side wall of said female member into a pair of longitudinally spaced first openings; and a second rib member provided upon said second side wall of said female member for separating said second opening defined within and extending through said second side wall of said female member into a pair of longitudinally spaced second openings.

10. The side release buckle of claim 9 wherein:

said first rib member of said first side wall of said female member is aligned with said second rib member of said second side wall of said female member.

11. The side release buckle of claim 9, wherein:

said pairs of first and second openings defined within said female member are elongated openings.

12. The side release buckle of claim 8 wherein:

said female member has first and second substantially opposed end walls further defining said receptacle; and first and second end apertures are defined within said first and second substantially opposed end walls of said female member for facilitating manipulation of said first and second laterally disposed latching arms of said male member when it is desired to releasably disengage said male member from said female member.

13. The side release buckle of claim 8, further comprising:

a male strap engagement member disposed upon said male member opposite said tongue portion of said male member; and a female strap engagement member disposed upon said female member opposite said receptacle of said female member.

14. The side release buckle of claim 8, wherein:

said first and second laterally disposed arms of said male member have corresponding shoulder engagement portions; and said female member has first and second substantially opposed end walls further defining said receptacle and having corresponding first and second end aperture edge portions cooperatively engageable with said corresponding shoulder engagement portions of said first and second laterally disposed arms of said male member.

15. A side release buckle, comprising:

a male member having a longitudinally extending axis and a tongue portion;

a female member having a longitudinally extending axis, a receptacle, defined partially by first and second substantially opposed side walls, for receiving said tongue portion of said male member, and latching means for releasably retaining said tongue portion of said male member within said receptacle;

an opening defined within and extending through a substantially axially central portion of said tongue portion of said male member so as to define upon said tongue portion of said male member a pair of laterally spaced, flexible latching arms for releasably engaging said latching means of said female member;

an axially extending guide arm interposed between and separated from said pair of laterally spaced flexible, latching arms so as to divide said opening of said tongue portion of said male member into first and second laterally spaced openings within said tongue portion of said male member, and a third opening defined within said axially extending guide arm; and first and second separate openings laterally spaced from each other upon opposite sides of said longitudinally extending axis of said female member and respectively defined within and extending through each one of said first and second substantially opposed side walls of said female member for at least partial alignment with said first and second openings of said male member when said tongue portion of said male member is disposed within said receptacle of said female member such that said at least partially aligned first and second openings of said male and female members together form first and second apertures through said side release buckle, and a third opening defined within and extending through said female member for at least partial alignment with said third opening of said guide arm of said male member when said tongue portion of said male member is disposed within said receptacle of said female member such that said at least partially aligned third openings of said male and female members together form a third aperture through said side release buckle.

16. The side release buckle of claim 15, further comprising:

a first rib member provided upon said first side wall of said female member for separating said first opening defined within and extending through said first side wall of said female member into a pair of longitudinally spaced first openings; and a second rib member provided upon said second side wall of said female member for separating said second opening defined within and extending through said second side wall of said female member into a pair of longitudinally spaced second openings.

17. The side release buckle of claim 16, wherein:

said first rib member of said first side wall of said female member is aligned with said second rib member of said second side wall of said female member.

18. The side release buckle of claim 16, wherein:

said pairs of first and second openings defined within said female member are elongated openings.

19. The side release buckle of claim 15, wherein:

said female member has first and second substantially opposed end walls further defining said receptacle; and first and second end apertures are defined within said first and second substantially opposed end walls of said female member for facilitating manipulation of said first and second laterally disposed latching arms of said male member when it is desired to releasably disengage said male member from said female member.

20. The side release buckle of claim 15, further comprising:

a male strap engagement member disposed upon said male member opposite said tongue portion of said male member; and a female strap engagement member disposed upon said female member opposite said receptacle of said female member.

21. The side release buckle of claim 15, wherein:

said first and second laterally disposed arms of said male member have corresponding shoulder engagement portions; and said female member has first and second substantially opposed end walls further defining said receptacle and having corresponding first and second end aperture edge portions cooperatively engageable with said corresponding shoulder engagement portions of said first and second laterally disposed arms of said male member.

* * * * *